US009376832B2

(12) United States Patent
Deering

(10) Patent No.: US 9,376,832 B2
(45) Date of Patent: Jun. 28, 2016

(54) PORTABLE SAFETY RAIL SYSTEM

(75) Inventor: Bradley E. Deering, Waconia, MN (US)

(73) Assignee: Safety Rail Company, LLC, Waconia, MN (US)

( * ) Notice: Subject to any disclaimer, the term of this patent is extended or adjusted under 35 U.S.C. 154(b) by 75 days.

(21) Appl. No.: 13/612,292

(22) Filed: Sep. 12, 2012

(65) Prior Publication Data

US 2013/0062585 A1 Mar. 14, 2013

Related U.S. Application Data

(60) Provisional application No. 61/533,587, filed on Sep. 12, 2011.

(51) Int. Cl.

| | |
|---|---|
| ***E04H 17/00*** | (2006.01) |
| ***E04H 12/22*** | (2006.01) |
| ***E04H 17/18*** | (2006.01) |
| ***E01F 13/02*** | (2006.01) |
| ***E04G 21/32*** | (2006.01) |

(52) U.S. Cl.

CPC ..... *E04H 12/2238* (2013.01); *E01F 13/022* (2013.01); *E04G 21/3238* (2013.01); *E04H 12/2269* (2013.01); *E04H 17/18* (2013.01)

(58) Field of Classification Search

CPC ..... E04G 21/3233; E04G 21/3238; E04F 9/0124; E04H 17/18; E04H 12/2238; E04H 12/22; E04H 12/2261; E04H 12/2269; E04H 12/2276; E01F 13/022

USPC ..... 256/65.14, DIG. 6, 65.01, 73; 160/351

See application file for complete search history.

(56) References Cited

U.S. PATENT DOCUMENTS

| | | | | |
|---|---|---|---|---|
| 413,716 | A * | 10/1889 | Hall | E04H 12/2269 52/298 |
| 673,037 | A * | 4/1901 | Swank et al. | E04H 12/2269 256/56 |
| 1,665,726 | A * | 4/1928 | Allison | E04H 12/22 15/235.4 |
| 3,119,588 | A * | 1/1964 | Keats | 248/158 |
| 3,776,521 | A | 12/1973 | Weinert | |
| 5,161,784 | A * | 11/1992 | Sader | 256/24 |
| 5,188,342 | A | 2/1993 | Ouellette et al. | |
| 5,816,554 | A * | 10/1998 | McCracken | 248/346.01 |
| 6,324,800 | B1 * | 12/2001 | Valentz et al. | 52/298 |
| 6,516,571 | B1 * | 2/2003 | Overthun et al. | 52/36.1 |
| 6,554,257 | B1 | 4/2003 | Kenton | |
| 6,578,827 | B2 * | 6/2003 | McCracken | 256/59 |

(Continued)

FOREIGN PATENT DOCUMENTS

NL 1008592 C2 * 9/1999

*Primary Examiner* — Daniel P Stodola
*Assistant Examiner* — Matthew R McMahon
(74) *Attorney, Agent, or Firm* — Christensen Fonder P.A.

(57) ABSTRACT

A portable safety rail system includes one or more railings inserted into one or more stackable rail bases. Each rail base can include a plurality of apertures for receiving end rail posts of railings through a raised hub defining an open region between the bottom of the hub and the surface on which the rail base rests. Each end rail post can have a stop flange that engages an upper surface of the hub when inserted therein and an aperture through the end portion that extends into the open region beneath the hub for receiving a pin to lock the post while allowing rotation of the post. The system can also include toe boards that are attached to railings with a mount having an aperture through which railings are extended, allowing the toe boards to also be rotated to be aligned with railings.

5 Claims, 9 Drawing Sheets

(56) References Cited

U.S. PATENT DOCUMENTS

| | | | | |
|---|---|---|---|---|
| 6,669,163 | B2 * | 12/2003 | Davis, Jr. | 248/346.01 |
| 6,845,970 | B1 * | 1/2005 | Kenton | 256/73 |
| 6,863,253 | B2 * | 3/2005 | Valentz et al. | 248/519 |
| 7,334,957 | B2 | 2/2008 | Sadinsky et al. | |
| 7,338,033 | B2 | 3/2008 | Anson et al. | |
| 7,344,051 | B2 * | 3/2008 | Flamingo et al. | 221/312 A |
| 7,553,103 | B2 * | 6/2009 | Jameson et al. | 404/9 |
| 7,614,819 | B1 | 11/2009 | Mirman et al. | |
| 7,722,285 | B2 * | 5/2010 | Schram et al. | 404/6 |
| 7,909,310 | B2 * | 3/2011 | Weiner | 256/45 |
| 8,132,792 | B2 | 3/2012 | Perris | |
| 8,689,938 | B2 * | 4/2014 | Kenton et al. | 182/113 |
| 8,919,361 | B2 * | 12/2014 | Ma | 135/16 |
| 2005/0056741 | A1 * | 3/2005 | Higgs et al. | 248/188.8 |
| 2006/0278472 | A1 * | 12/2006 | Kenton et al. | 182/113 |
| 2008/0028718 | A1 * | 2/2008 | Erickson et al. | 52/687 |
| 2009/0212270 | A1 * | 8/2009 | Collins, IV | 256/19 |
| 2010/0044661 | A1 * | 2/2010 | Weiner | 256/1 |
| 2011/0311754 | A1 * | 12/2011 | Kray | 428/66.6 |

* cited by examiner

PORTABLE SAFETY RAIL SYSTEM

This application claims priority to U.S. Provisional Application 61/533,587, filed on Sep. 12, 2011, the contents of which are incorporated herein by reference.

FIELD OF THE INVENTION

The present invention relates to protective barriers for preventing falls or blocking access to a hazardous area. More particularly, the present invention relates to a portable safety rail system.

BACKGROUND OF THE INVENTION

Safety rail systems are used to provide a barrier around work areas where worker safety is an issue. Examples include construction sites, such as to keep workers from falling off an edge of a roof or falling down uncompleted stairwells and to keep the general public out of the site as well as limiting access at festivals, sporting events, and the like. Such systems must be portable to allow for temporary work to be done while also being sturdy enough to not easily tip over or otherwise accidentally move or dislodge. Portable safety rail systems must also exceed OSHA safety regulations for permanent safety railings.

Conventional portable rail systems are modular systems that are assembled on a given job site in accordance with the specific work constraints of the site. As such they must be stored when not in use. Such systems typically utilize tubular railings having horizontal rails extending between vertical posts. The lower ends of the railings are slid into tubular sockets or receptors of bases. Gates that can be opened or closed can also be provided to allow selective passage into and out of the barricaded area. Typically the bases are quite heavy, 40 pounds or more, for example. Storage and transportation of these bases can be problematic as prior bases have not stacked securely and trying to transport them as a stack can be hazardous due to their weight.

U.S. Pat. No. 6,554,257 discloses one portable safety rail system that utilizes a plurality of bases into which tubular guardrail sections can be inserted. The system is modular and can be assembled into various configurations of bases, rail sections and gates. The rail sections can be set at any angle from the bases, however, they are unable to rotate once they are locked into place and locking them in place can be difficult because holes in the railings must be properly aligned with slots in the base. In addition, use of a gate requires a number of additional and different parts. Further, the configuration of the bases does not allow them to be stably stacked for transport and storage.

As such, it would be advantageous for portable safety rail systems to provide a greater and simpler degree of customizability and a simpler and easier system for transport and storage.

SUMMARY OF THE INVENTION

A portable safety rail system includes one or more railings inserted into a plurality of rail bases. Each rail base can include a plurality of apertures for receiving end rail posts of railings through a raised hub defining an open region between the bottom of the hub and the surface on which the rail base rests. Each end rail post can have a stop flange that engages an upper surface of hub when inserted therein and an aperture through the end portion that extends into the open region beneath the hub. A pin can be inserted through the aperture in the railing to lock the railing with respect to the rail base, while still allowing the railing to be rotated through 360 degrees of motion even when locked with respect to the rail base. System can also include toe boards that are attached to railings with a mount having an aperture through which railing posts are extended, allowing the toe boards to also be rotated to be aligned with railings.

In an embodiment of the invention, a rail base for a portable safety rail system can include an outer base portion that may be shaped as a wheel and that rests on a surface, such as a roof surface, and a central hub connected to the base portion by a plurality of support members, such as spokes, such that the central hub is in a raised position relative to the outer base portion. Raised collars define apertures through each hub for receiving railings of the rail system. The raised position of central hub defines a central open area beneath hub. This allows rail bases to be stacked on top of one another in a stable manner with adjacent base portions resting flush against each other because the hub including raised collars of a rail base below fit within the central open area of the rail base positioned directly above said rail base.

In another embodiment of the invention, a gate can be incorporated into portable safety rail system to provide selective access to and from an area. Due to the ability of railings to rotate 360 degrees when locked with rail bases, a standard railing can function as the gate door. A wheel can be added to the end rail post of the railing opposite of the rail base to support the end of the door and allow the door to be easily opened and shut. A latch stand can be attached to an adjacent base to allow the door of the gate to be latched. A first end of the latch can be inserted into an aperture through a collar of the base while a second end can be inserted through an additional aperture in order to prevent rotation of the latch stand so that it provides a secure and stable latching point.

A feature and advantage of embodiments of the present invention is that the railings can be rotated through a 360 degree range of rotation even when locked into place in rail bases. This allows for significantly enhanced customizability of portable rail safety systems that can be configured for any shaped area.

Another feature and advantage of embodiments of the present invention is that toe boards can be connected to the system with a mount having an aperture through which a railing post is extended prior to being inserted in hub. This results in the toe boards also being rotatable in a 360 degree range of motion to allow them to be aligned with railings when railings are rotated. Additionally it provides a very robust connection of the toe boards to the railing.

A further feature and advantage of embodiments of the present invention is that the railings are locked to the base by inserting a locking pin that only needs to go through the railing. This allows railings to be inserted and locked much more quickly and easily than systems requiring complementary holes in the railings and bases to be aligned.

Another feature and advantage of embodiments of the present invention is that the central open region beneath the hub of the rail bases allows the bases to be stacked, when not in use, in a stable manner. This improves the ability of the system to be stored and transported, because it can be done so in a smaller area and in a more stable manner.

A further feature and advantage of embodiments of the present invention is that standard railings can function as doors for gates due to the ability of railings to rotate through a 360 degree range of motion. This reduces the number and size of parts needed for the system.

DETAILED DESCRIPTION OF THE DRAWINGS

Figure 1A:
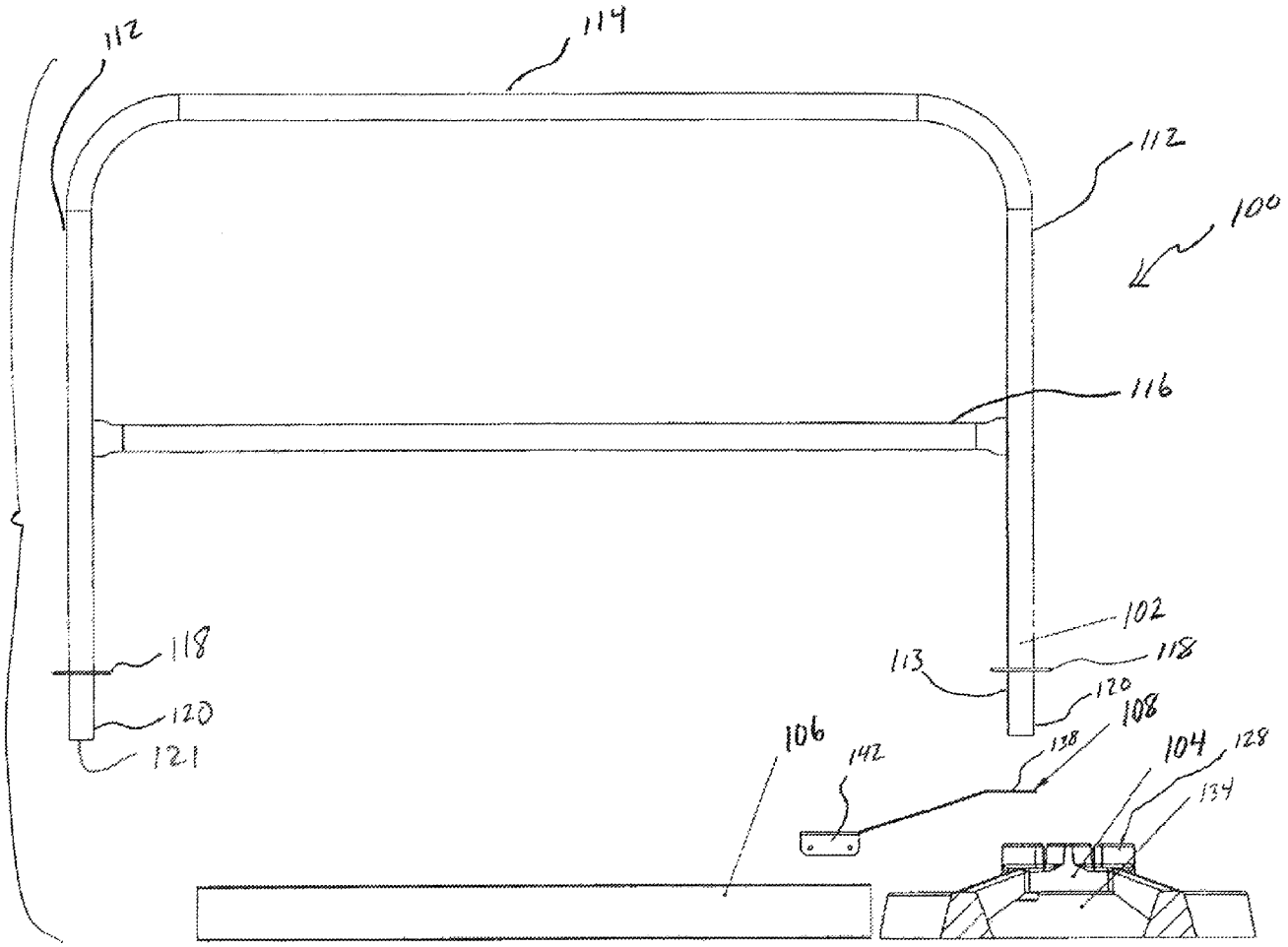
FIG. 1*a* is an exploded view of a portable safety rail system according to an embodiment of the present invention.
Figure 1B:
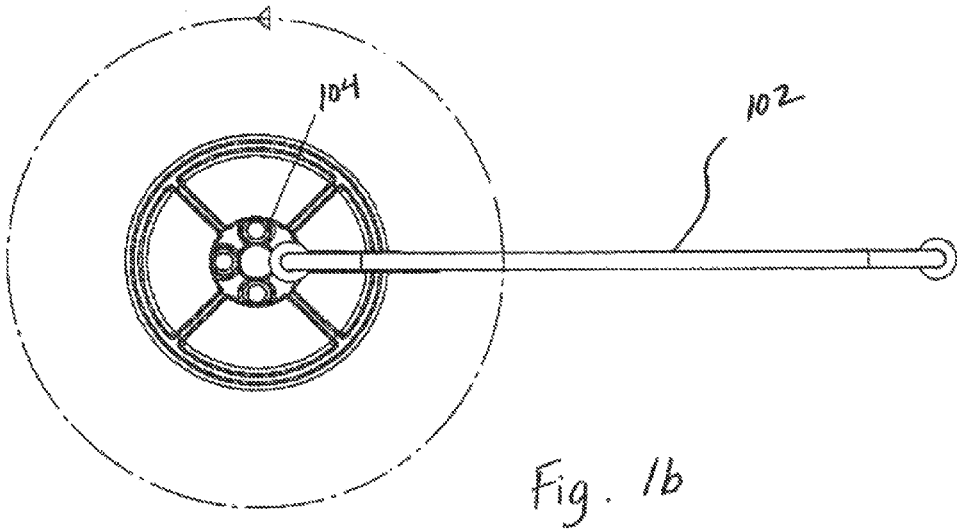
FIG. 1*b* is a top view of the portable safety rail system of FIG. 1*a*.
Figure 1C:
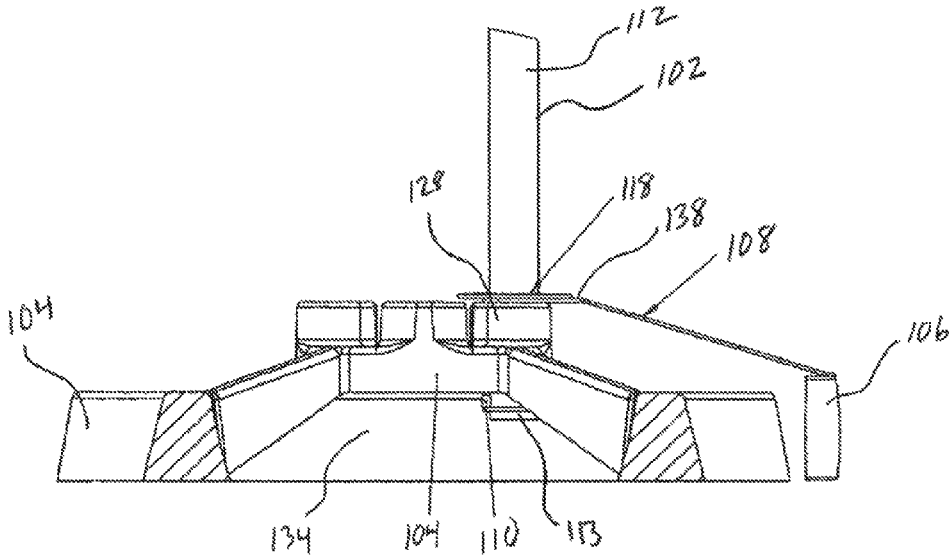
FIG. 1*c* is a partial cross-sectional side view of the portable rail safety system of FIG. 1*a*.
Figure 2A:
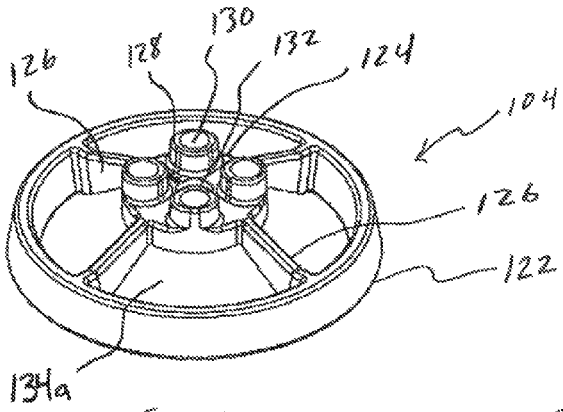
FIG. 2*a* is a perspective view of a rail base of a portable safety rail system according to an embodiment of the present invention.
Figure 2B:
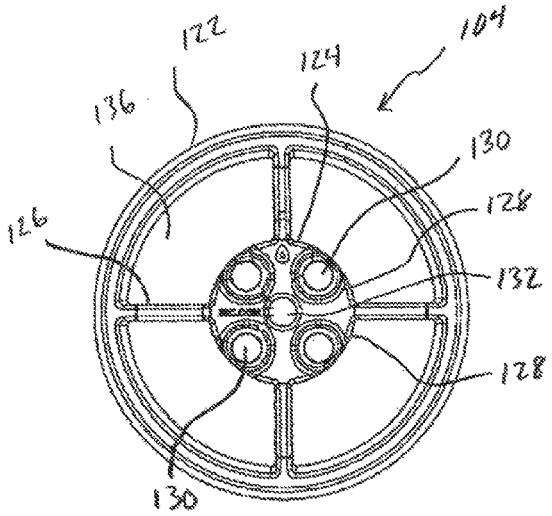
FIG. 2*b* is a top view of the rail base of FIG. 2*a*.
Figure 2C:
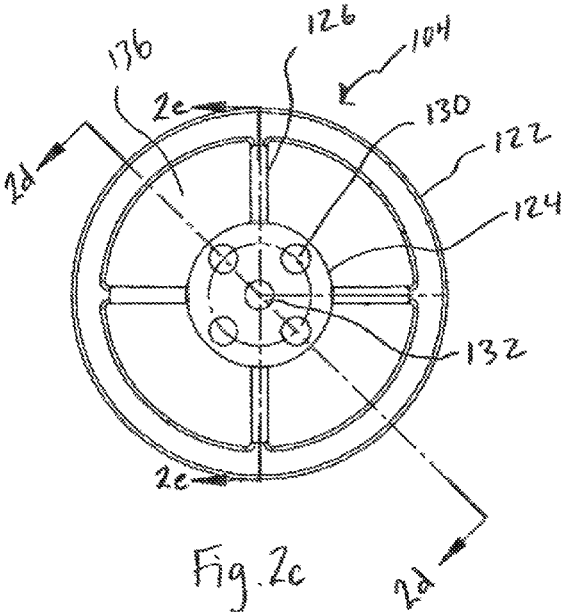
FIG. 2*c* is a bottom view of the rail base of FIG. 2*a*.
Figure 2D:
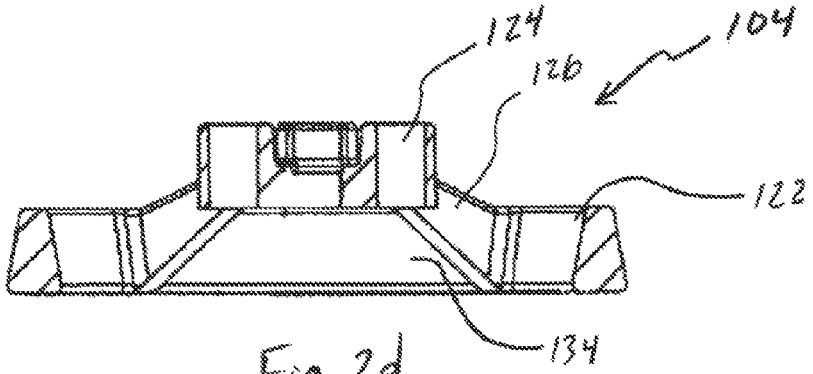
FIG. 2*d* is a cross-sectional view of the rail base of FIG. 2*a* taken along the lines 2*d*-2*d* in FIG. 2*c*.
Figure 2E:
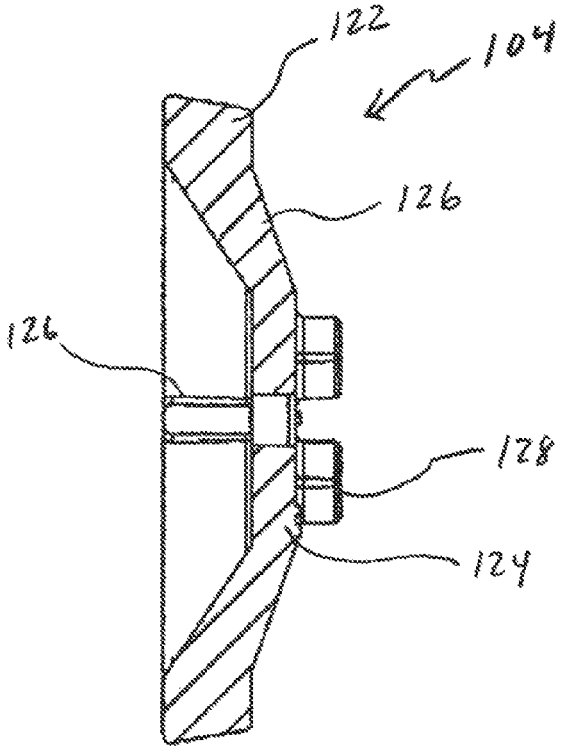
FIG. 2*e* is a cross-sectional view of the rail base of FIG. 2*a* taken along the lines 2*e*-2*e* in FIG. 2*c*.

FIGS. 1*a*-1*c* depict the components of a portable safety rail system 100 according to an embodiment of the present invention. Rail system 100 can include a railing 102, a rail base 104, a toe board 106 and a toe board mount 108. As can be seen in the FIGS. and will be discussed in more detail below, railing 102 can be inserted into rail base 104 and a pin 110 can be inserted into railing 102 to lock the railing 102 against translational movement relative to rail base 104. As is indicated by the arrow in FIG. 1*b*, railing 102 can be rotated 360 degrees relative to rail base 104 even after the pin 110 is inserted to secure the railing 102 to the rail base 104. Toe board mount 108 is captured between the railing 102 and the rail base 104 at one end and secured to toe board 106 at an opposing end. Rail system 100 complies with all applicable OSHA requirements.

Railing 102 can be formed from a plurality of tubular rails, including vertical end rail posts 112, top rail 114 and one or more support rails 116. In one embodiment, railing 102 is formed from steel. Railing 102 can further include a stop flange 118 along one or both of vertical end rail posts 112 that forms a ledge. In one embodiment, stops configured as stop flanges 118 can be welded onto end rail posts 112. Below stop flange 118, end rail posts 112 of railing 102 can further include a pin insertion aperture 120 extending through end rail post 112. The tubing may generally be steel and the diameter may be 1 inch to 3 inches. Alternatively other metals such as aluminum may be practical. The stops may be welded two to six inches from the tip end 121 of each railing end post.

Referring now to FIGS. 2*a*-2*e*, further detail of a rail base 104 according to an embodiment of the present invention can be seen. Rail base 104 can include an outer base portion 122 and a central hub 124 connected by a plurality of support members 126. Post receiving portion configured as a hub 124 can include a plurality of collars 128 defining rail receiving apertures 130 extending through hub 124 and one or more additional apertures 132. As can be seen most clearly in FIGS. 2*d* and 2*e*, hub 124 defines a hub plate with a side edge, and base portion 122 can be adapted to rest on a surface with support members 126 extending at an angle upwardly to hub 124 so that hub 124 is elevated relative to base portion 122 forming an open region 134 between the hub 124 and the surface upon which base portion 122 rests. Open gaps 134*a* are also present between support members 126 as they extend from base portion 122 to hub 124. In one embodiment, rail bases 104 can be formed from cast iron.

Figure 3A:
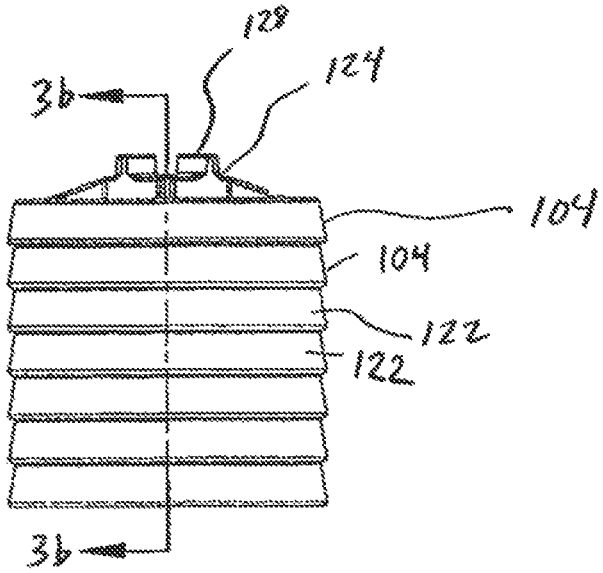
FIG. 3*a* is a side view of a plurality of rail bases of a portable safety rail system according to an embodiment of the present invention.
Figure 3B:
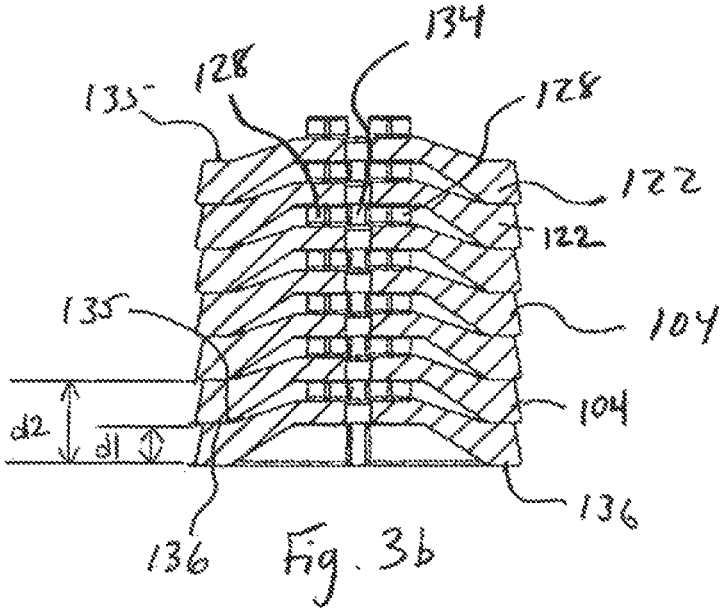
FIG. 3*b* is a cross-sectional view of the rail bases of FIG. 3*a* taken along the lines 3*b*-3*b* in FIG. 3*a*.
Figure 4A:
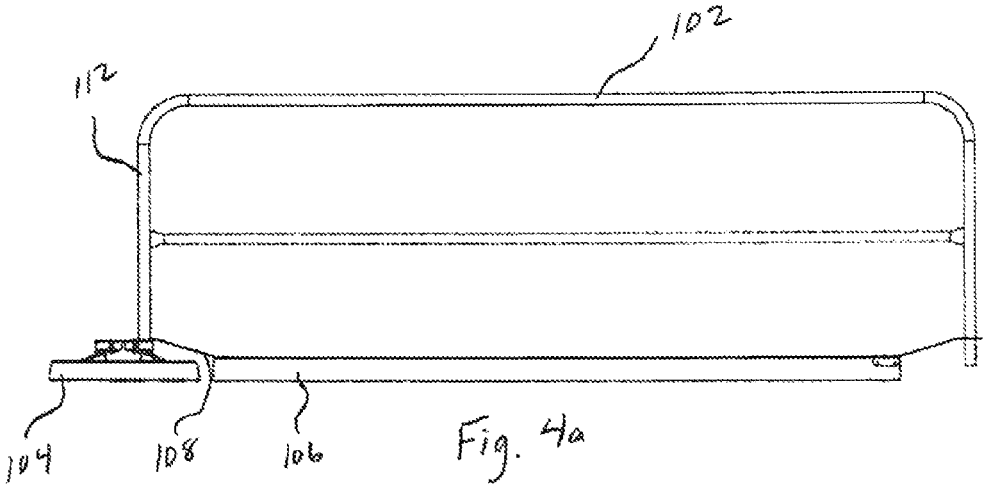
FIG. 4*a* is a side view of a portable safety rail system according to an embodiment of the present invention.
Figure 4B:
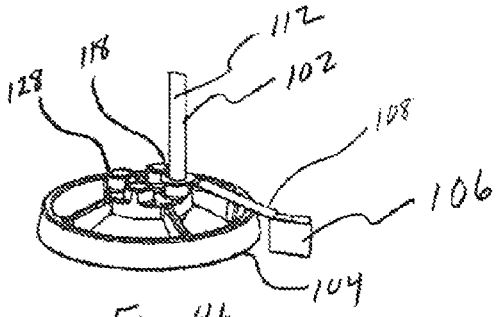
FIG. 4*b* is a partial perspective view of the portable safety rail system of FIG. 4*a*.
Figure 4C:
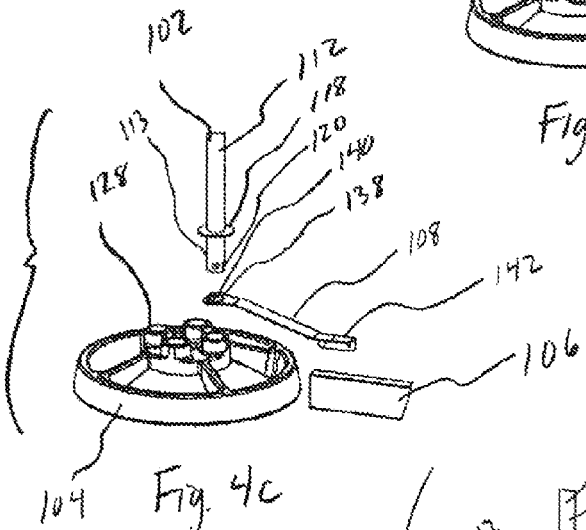
FIG. 4*c* is a partial exploded perspective view of the portable safety rail system of FIG. 4*a*.
Figure 4D:
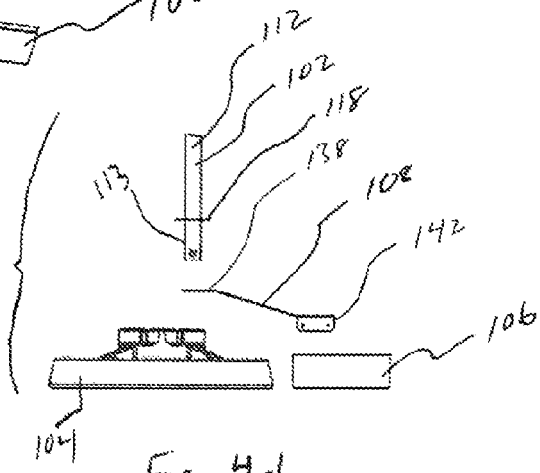
FIG. 4*d* is a partial side view of the portable safety rail system of FIG. 4*a*.

Rail bases 104 can be stacked on top of each other as shown in FIGS. 3*a* and 3*b*. Open areas 134 underneath hubs 124 allow adjacent base portions 122 of rail bases 104 to rest on top of each other with collars 128 of a rail base 104 below fitting into open area 134 of a rail base 104 above while also allowing the bottom surface 136 of the base portion 122 of the rail base 104 above to rest flush on the top surface of the base portion 122 of the rail base 104 below. This provides a stable stack that is not prone to tipping and is not possible with standard rail bases that do not incorporate open areas 134. Stably stackable rail bases 104 provide for significantly easier shipment and storage of rail bases 104. Each base has an upper seating surface 135 for receiving the bottom or lower seating surface 136 of another base. For each base the distance d1 between the lower seating surface and upper seating surface defines an effective stacking height and each base has a height d2. The stacking height in particular embodiments is less that 80% of the height, in particular embodiments it is less than 70% of the height and in particular embodiments is less than 60% of the height. The ratio of the stacking height to the height provides a measurement of the nesting of the bases when stacked with the lower the ratio the greater the nesting and correspondingly the greater the stability of the stacked bases.

The bases may be made of cast iron and weigh between 40 pounds and 100 pounds. The bases may have a diameter of from 12 inches to 30 inches.

Referring again to FIGS. 1*a*-1*c* and to FIGS. 4*a*-4*d*, the details of how components of safety rail system 100 fit together can be seen. Rail engagement portion 138 of toe board mount 108, which has an aperture 140 therethrough, can rest on a collar 128 of rail base 104. End portion 113 of end rail post 112 of railing 102 can be inserted through the aperture 130 through hub 124 at collar 128 (and through aperture 140) until the stop flange 118 of the railing 102 engages the collar 128, capturing the rail engagement portion 138 of the toe board mount therebetween. Stop flange 118 also serves to ensure that the end rail post 112 is not over-inserted and that the aperture 120 through the end rail post 112 is in open region 134. The pin 110 is then inserted through the aperture 120 to secure the railing 102 to the rail base 104. Aperture 120 can be accessed to insert pin 110 due to the open area provided by both open area 134 beneath hub 124 and the gaps 134*a* between support members 126. Insertion of pin 110 does not require any specific alignment of railing 102 and rail base 104 because the pin 110 only goes through the railing 112 below the hub 124, so the process of insertion and locking is simplified. The toe board 106 is secured to a bracket 142 of toe board mount 108 by, for example, mechanical fasteners either before or after railing 102 is secured to rail base 104.

Toe board 106 serves to keep objects from being kicked or otherwise accidentally knocked under the rail system 100, and, in many uses of rail system 100H, subsequently off of an elevated surface onto the public or other area below.

The single securing point that constrains the railing 102 translationally but not rotationally relative to the rail base 104 allows the railing 102 to have 360 degrees of rotation relative to the rail base even while they are secured together. This provides simplified adjustment capability relative to the prior art, which requires rotation of the railing prior to securing to the base and alignment of openings in both the railing and the base. In addition, the aperture 140 through rail engagement portion 138 of toe board mount 108 allows toe board mount 108, as well as toe board 106, to similarly be rotated through 360 degrees of rotation. 360 degree positioning provides increased flexibility in assembling portable security rail systems 100, which can be beneficial in adjusting the system to a specific situation, such as assembling the system around obstacles or in a curved manner.

Figure 5A:
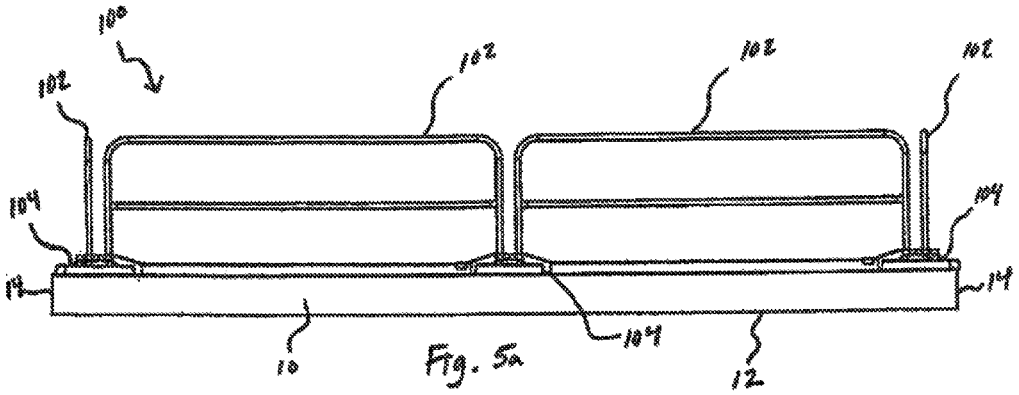
FIG. 5*a* is a side view of a portable safety rail system according to an embodiment of the present invention.
Figure 5B:
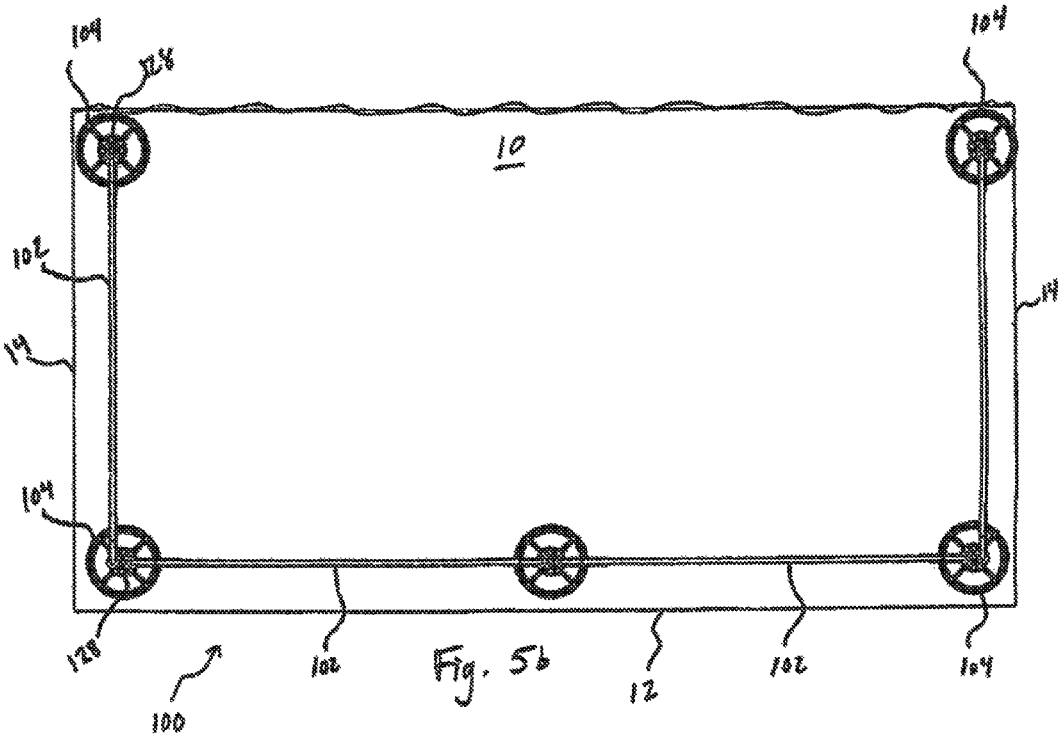
FIG. 5*b* is a top view of the portable safety rail system of FIG. 5*a*.
Figure 6A:
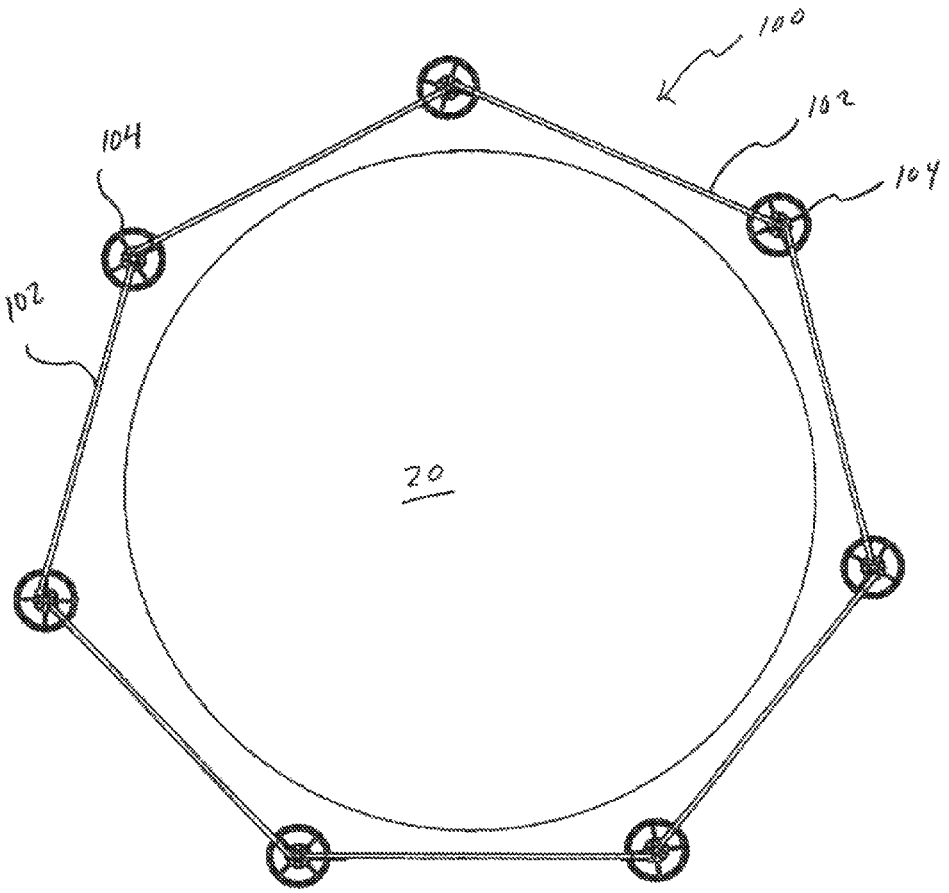
FIG. 6*a* is a top view of a portable safety rail system according to an embodiment of the present invention.
Figure 6B:
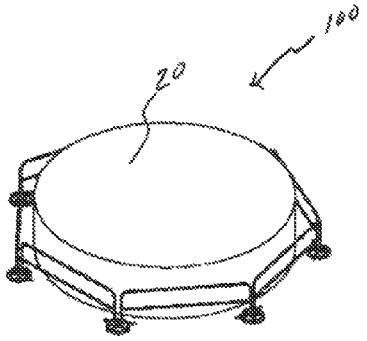
FIG. 6*b* is a perspective view of the portable safety rail system of FIG. 6*a*.

FIGS. 5*a*-5*b* depict a portable safety rail system 100 having a plurality of rails 102 and rail bases 104 in a typical usage configuration. Safety rail system 100 is positioned on an elevated surface 10 to prevent people and objects from falling off of a front edge 12 and side edges 14 of surface 10. Rail system 100 is assembled on site and set up to fit the specific geometry of the surface 10. As can be seen in the FIGS., the safety rail system 100 configured for this specific surface 10 utilizes five rail bases 104 and four railings 102. System 100 also includes toe boards 106 to prevent objects from rolling off of surface 10. Depending on the positioning of each rail base 104 within system 100, each rail base has one or two, and can have up to four, railings 102 inserting into collars 128 of rail bases. Referring now to FIGS. 6*a* and 6*b*, another typical configuration of a portable safety rail system 100 is depicted. In this embodiment, system 100 is used to prevent access to an area 20. System 100 can be advantageously used to provide a barrier for and prevent access to curved and non-uniformally shaped areas due to the ability of railings 102 to be rotated within rail bases 104 through 360 degrees of rotation. In fact, in the hexagonally configured example in FIGS. 6*a* and 6*b*, each railing 102 extends from each of its rail bases 104 at a different angle than the adjacent railing 102 that shares the same rail base 104. The toe boards and toe board mounts are illustrated in FIG. 5*a* connected. In embodiments the portable rail system may include preassembled, such as by welding, toe boards with the toe board mounts already attached.

Figure 7:
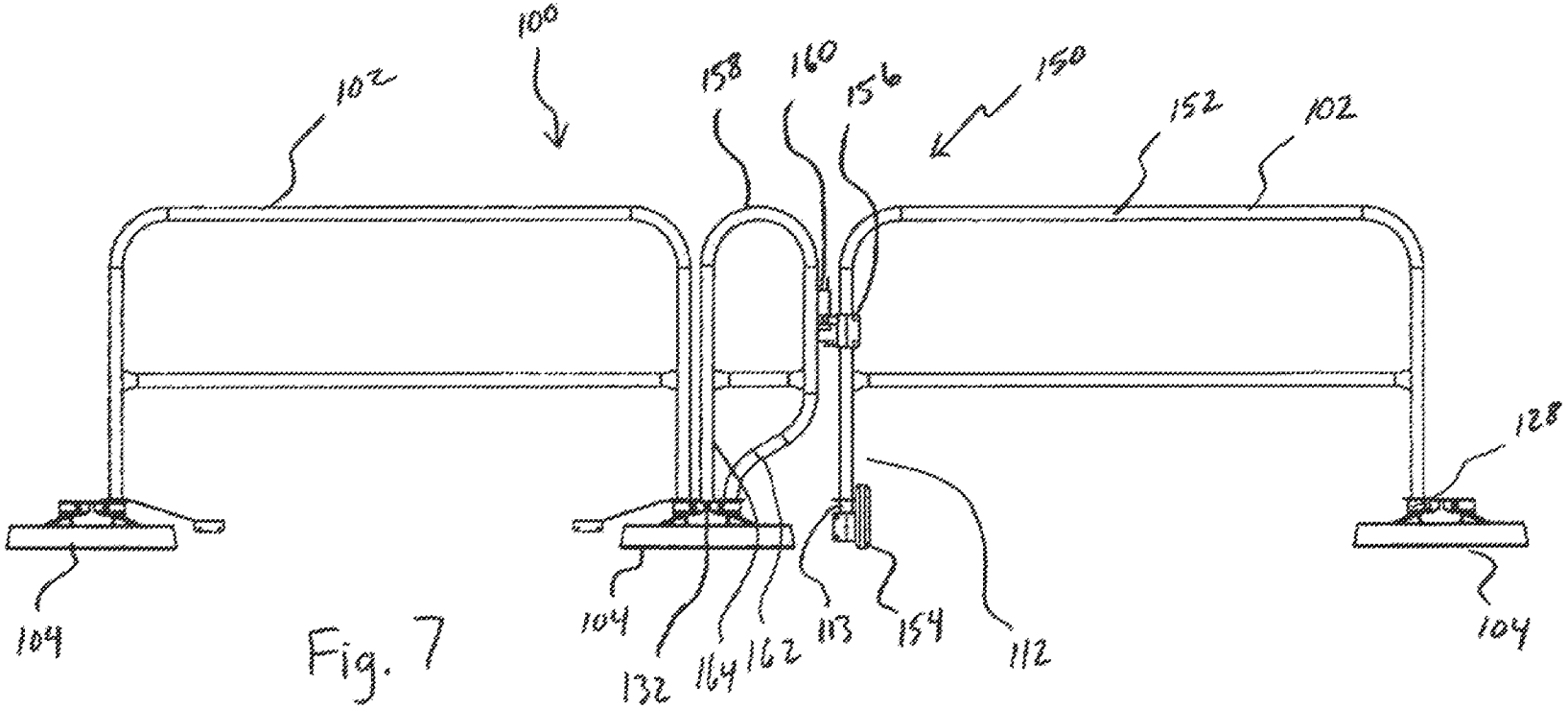
FIG. 7 is a side view of a portable safety rail system according to an embodiment of the present invention.

FIG. 7 depicts a further embodiment of the present invention that includes a gate 150. Gates 150 are useful in situations where selective access to and from the barricaded site is necessary or desired. Advantageously, door 152 of gate 150 can be a standard railing 102 with the same basic structure as all of the other railings 102 in the system, so an additional gate door does not need to be purchased and brought with the system 100 each time it is used. To utilize a railing 102 as a door 152 for a gate 150, the railing 102 is inserted and locked into the collar 128 of a rail base 104 as described previously. A wheel 154 can be attached to the end portion 113 of the opposite end rail post 112 of the railing 102 to aid in opening and closing the gate door 152 and to provide stability to door 152. Due to the ability of railings 102 to be rotated through a 360 range of motion even when locked into place in rail bases 104, gate door 152 can be opened to allow entry or exit through the entire distance between adjacent rail bases 104. A latch stand 158 can be positioned on an adjacent rail base 104 having a first latch portion 160 that cooperates with a second latch portion 156 on door 152 to allow the door 152 to be selectively latched and/or locked. A first leg 162 of latch stand 158 can be inserted into a collar 128 of rail base 104 and locked with a pin similar to how railings 102 are inserted and locked in place. A second leg 164 of latch stand 158 can be inserted into an additional aperture 132 positioned in rail base 104, as, for example can be best seen in FIGS. 2*b* and 2*c*. By inserting the second leg 164 into the aperture 132, the latch stand 158 is prevented from rotating, allowing the latch stand 158 to provide a stable latching source for the gate door 152.

The present invention may be embodied in other specific forms without departing from the spirit of any of the essential attributes thereof. Therefore, the illustrated embodiments should be considered in all respects as illustrative and not restrictive, reference being made to the appended claims rather than to the foregoing description to indicate the scope of the invention.

The invention claimed is:

1. A portable safety rail system comprising a plurality of bases and a plurality of railings, each railing having a pair of rail end posts and rails extending therebetween, each base comprising a circular base portion and end post receiving portion positioned inwardly from the circular base portion, the end post receiving portion including upstanding members adapted to receive a plurality of the rail end posts, the bases positioned sequentially on a surface and spaced from one another with railings extending between sequential bases, the system further comprising toe boards attached to at least two sequential bases by way of toe board mounts positioned on the respective two bases with railing end posts extending through the toe board mounts, each toe board mount including a substantially flat flange and each rail end post defining a stop for limiting movement of the post within a corresponding upstanding member;

wherein the substantially flat flange of each toe board mount is secured between the rail end post stop and the upstanding member to secure the toe board mount with respect to a respective base.

2. The portable safety rail system of claim 1 further comprising a gate railing positioned in one of the bases and latchable to a railing positioned in an adjacent base.

3. The portable safety rail system of claim 1 wherein each base is nestable with the other bases when disassembled such that the upstanding members of one base are simultaneously received within a single recess disposed underneath the end post receiving portion of another base.

4. The portable safety rail system of claim 1 wherein each railing end post is securable in the respective base with a pin extending through the respective railing end post at a position below the post receiving portion of the respective base.

5. A portable safety rail system comprising a plurality of bases and a plurality of railings, each railing having a pair of rail end posts and rails extending therebetween, each base comprising a circular base portion and a circular hub portion spaced inwardly and upwardly from the circular base portion and supported by a plurality of spokes extending between the circular hub portion aid the circular base portion, each hub portion having a plurality of vertically extending collars defining apertures sized for receiving the rail end posts, the collars being disposed above the spokes; wherein each of the rail end posts has a stop flange extending circumferentially proximate a lower end of each railed post, the position of said stop flange defining an insertion distance of the rail end post into the hub portions; the system further comprising a plurality of toe board mounts and at least one toe board, wherein each toe board mount comprises a substantially flat flange portion with a circular aperture sized to receive the railings end posts, the substantially flat flange portion being sandwiched between a respective collar and a respective stop flange.

* * * * *